US005239327A

United States Patent [19]

Frank

[11] Patent Number: 5,239,327

[45] Date of Patent: Aug. 24, 1993

[54] PROCESSOR FOR LIGHT SENSITIVE MATERIAL

[75] Inventor: Lee F. Frank, Rochester, N.Y.

[73] Assignee: Eastman Kodak Company, Rochester, N.Y.

[21] Appl. No.: 633,490

[22] Filed: Dec. 28, 1990

[51] Int. Cl.[5] ..... G03D 3/02

[52] U.S. Cl. ..... 354/320; 354/322; 354/324

[58] Field of Search ..... 354/319, 320, 321, 322, 354/324, 325

[56] References Cited

U.S. PATENT DOCUMENTS

| | | | |
|---|---|---|---|
| 3,186,326 | 1/1965 | Schmidt | 354/321 |
| 3,192,845 | 7/1965 | Schmidt | 354/321 |
| 3,310,062 | 3/1967 | Little | 354/319 |
| 3,372,630 | 3/1968 | Schmidt | 354/324 |
| 3,405,627 | 10/1968 | Day et al. | 134/122 P |
| 3,457,898 | 7/1969 | Frauchiger et al. | 354/325 |
| 3,516,345 | 6/1970 | Meyer | 354/319 |
| 3,595,159 | 7/1971 | Bull | 95/94 |
| 3,610,131 | 10/1971 | Frick et al. | 354/319 |
| 3,688,677 | 9/1972 | Fsick et al. | 134/122 P |
| 3,831,612 | 9/1972 | Limoges | 134/122 |
| 3,988,756 | 10/1976 | Wick et al. | 354/319 |
| 4,359,279 | 11/1982 | Popoff | 354/320 |
| 4,577,949 | 3/1986 | Geyken et al. | 354/319 |
| 4,989,028 | 1/1991 | Hall et al. | 354/324 |
| 4,994,840 | 2/1991 | Hall et al. | 354/324 |

*Primary Examiner*—A. A. Mathews

*Attorney, Agent, or Firm*—James A. Smith

[57] ABSTRACT

A processor for a web of light sensitive material comprises a plurality of hydrostatic bearings positioned within a processing tank to be submerged within a processing solution. Each of the bearings comprise a pair of juxtaposed housings on opposite sides of the web. Each of the housings include an aperture for emitting liquid under pressure to establish liquid cushions on opposite sides of the web which support the web without physical contact with the bearings.

11 Claims, 9 Drawing Sheets

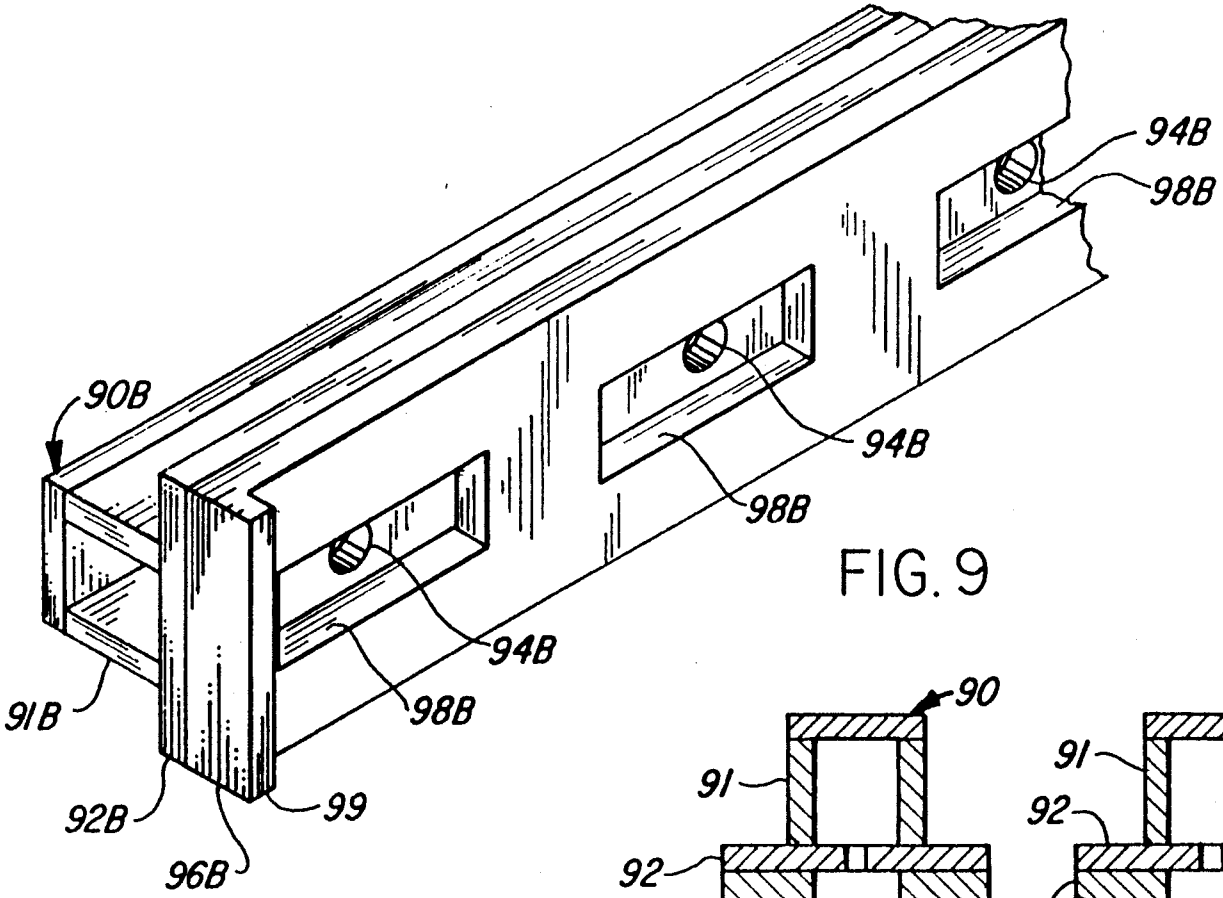
FIG. 9
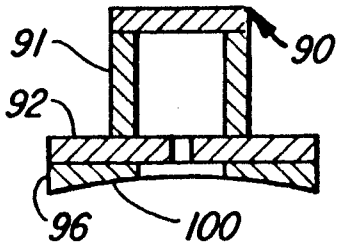
FIG. 10A
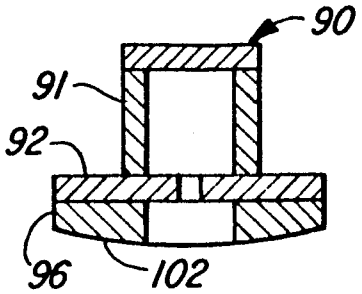
FIG. 10B
FIG. 10C

PROCESSOR FOR LIGHT SENSITIVE MATERIAL

CROSS REFERENCE TO RELATED APPLICATION

Reference is made to commonly assigned copending application Ser. No. 07/633,505 entitled "Apparatus for Enhancing Heat and Mass Transfer in a Fluid Medium" and filed concurrently herewith by Lee F. Frank, Jeffrey L. Helfer, Haribhajan S. Kocher and Paul W. Wagner, now U.S. Pat. No. 5,136,323. The disclosure of such application is incorporated herein by reference.

TECHNICAL FIELD

This invention relates to processor for light sensitive material such as photographic film or paper and, more specifically, to a processor having hydrostatic bearings for supporting the material being processed.

BACKGROUND ART

In U.S. Pat. No. 4,994,840 issued Feb. 19, 1991 and entitled Apparatus for Processing Photosensitive Material there is disclosed a processor for photographic film or paper comprising a levitation chamber submersed in a tank. The film or paper is transported through the chamber. The static pressure of the fluid in the tank is used to circulate processing solution through the chamber. The film or paper web is fed into the end of a processing channel. Processing fluid is introduced at the opposite ends of the channel and discharged at the center of the channel.

DISCLOSURE OF THE INVENTION

It is an object of the present invention to provide a submersed tank processor having a plurality of hydrostatic bearings for supporting a web of light sensitive material (in continuous or sheet form) during transport through a processing tank. In accordance with the invention, a plurality of hydrostatic bearings are supported in spaced relationship in a processing chamber filled with processing solution. Processing solution is circulated by a pump from the chamber to a manifold and to the bearings. The solution is discharged by the bearings into contact with the film to effectively suspend the film out of contact with bearing surfaces.

BRIEF DESCRIPTION OF THE DRAWINGS

Other objects and advantages will become apparent from the following description taken in connection with the following drawings wherein:

FIGS. 8 and 9 are enlarged perspective views of portions of a hydrostatic bearing;

FIGS. 10A–C are enlarged cross sections showing three configurations of the hydrostatic bearing.

MODE OF CARRYING OUT THE INVENTION

Figure 1:
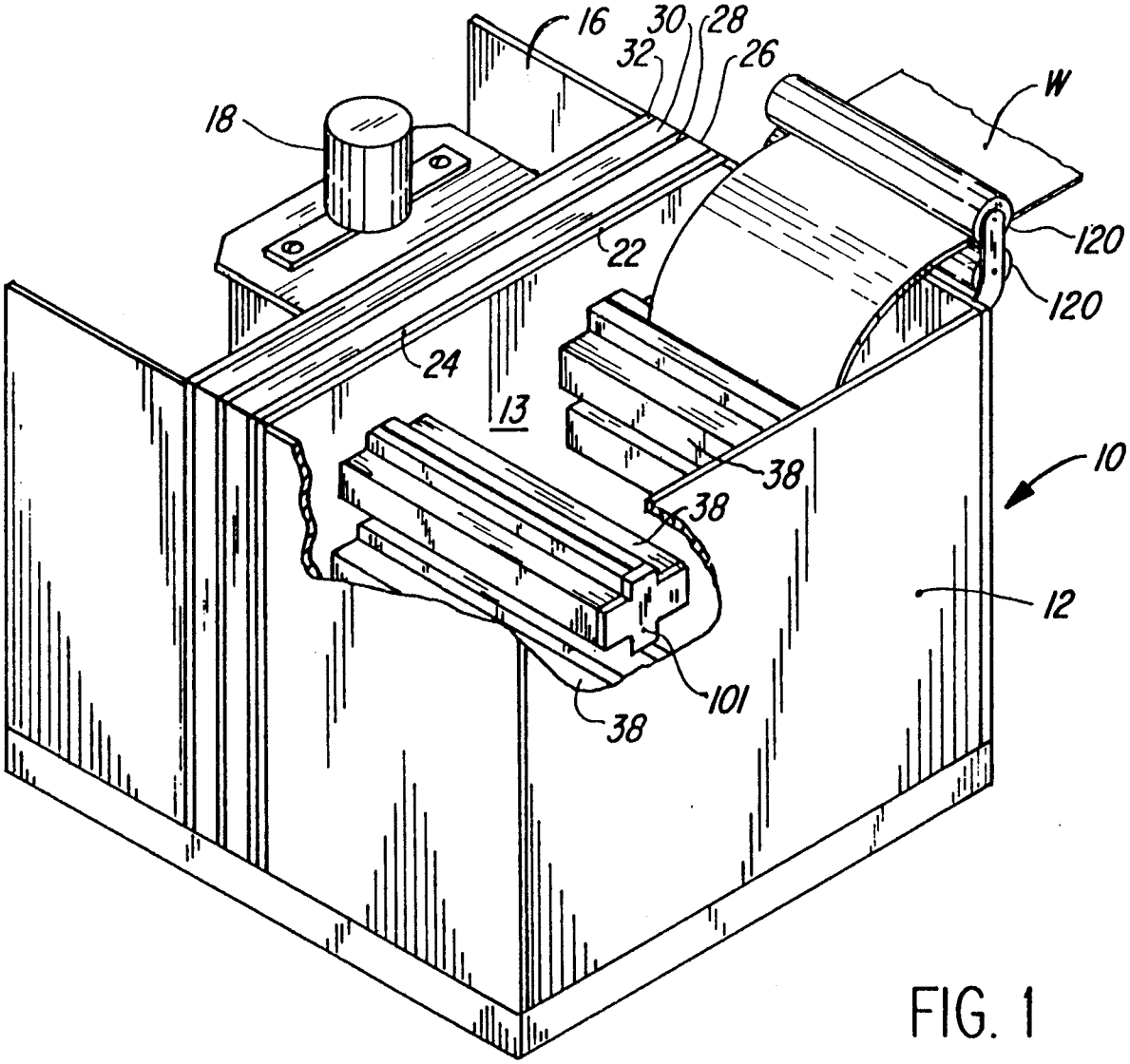
FIG. 1 is a perspective view of a processor in accordance with the invention with the top removed and a portion of the sidewalls cut away to illustrate internal parts.
Figure 2:
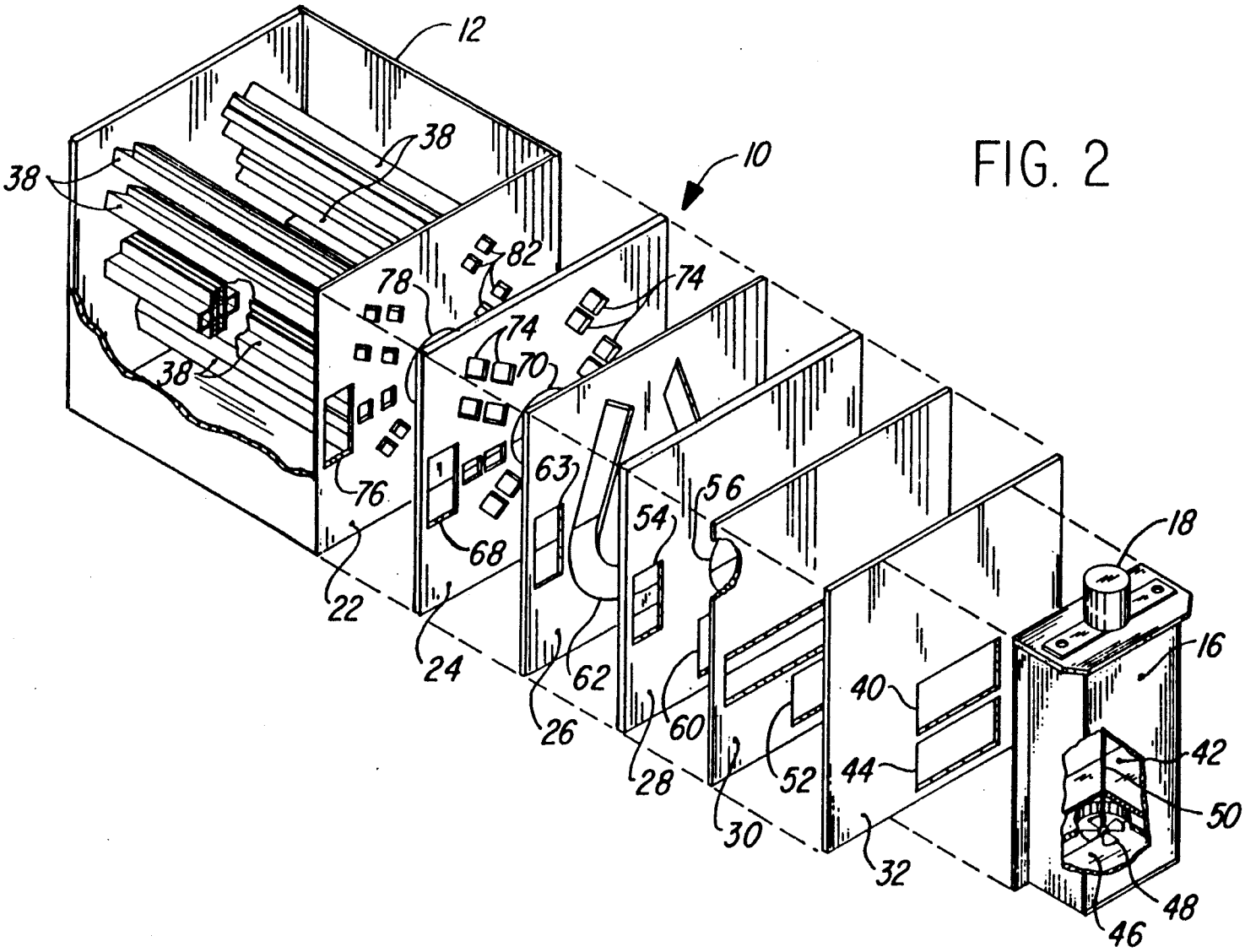
FIG. 2 is an exploded perspective view of the processor shown in FIG. 1.
Figure 4G:
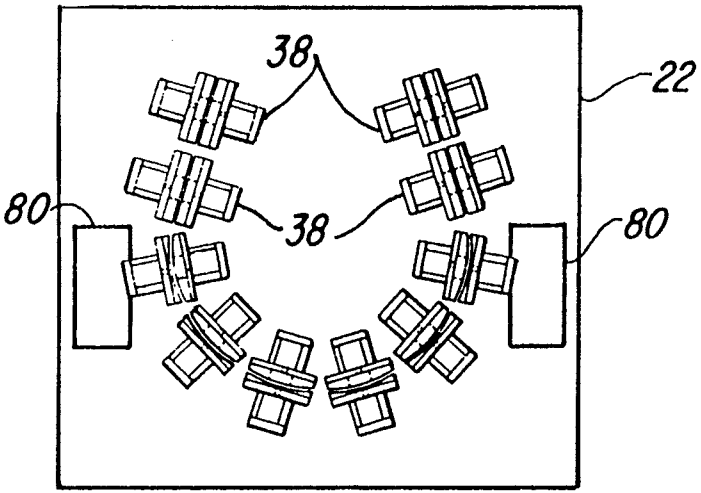
FIGS. 4A–G are front views of the manifold plates or walls of the processor.
Figure 4C:
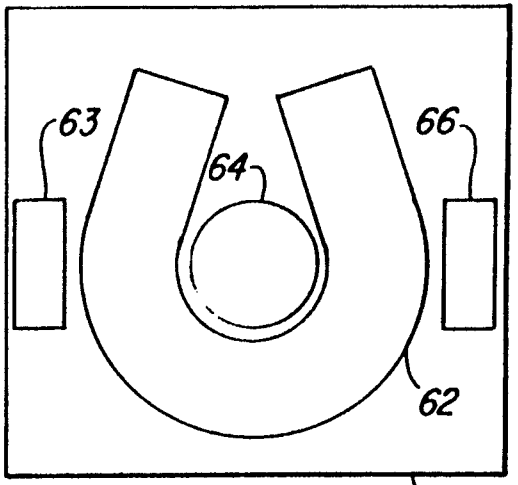
Figure 4F:
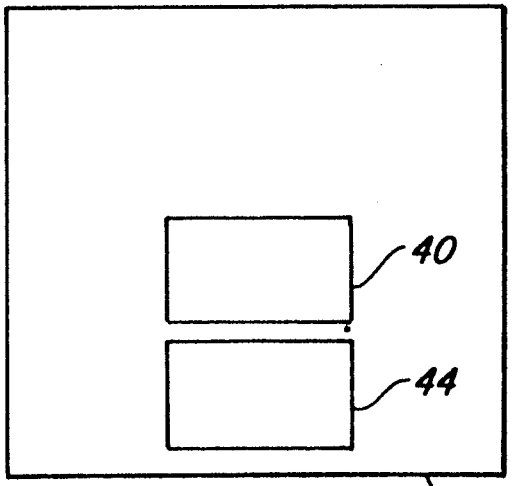
Figure 4B:
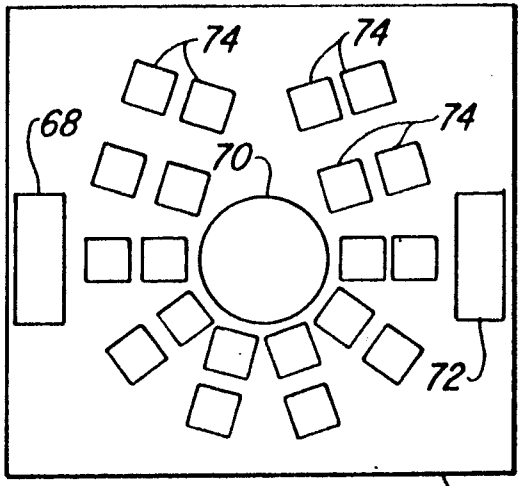
Figure 4E:
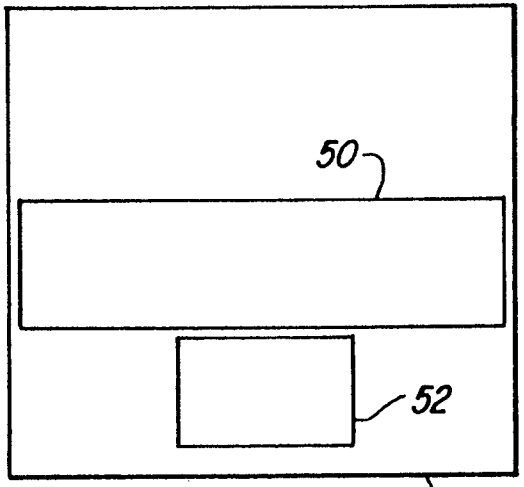
Figure 4A:
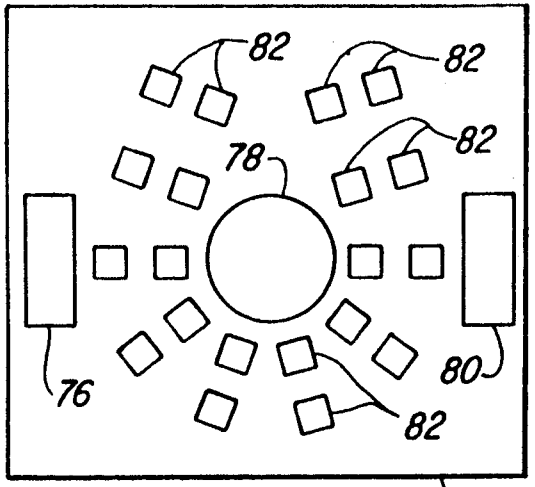
Figure 4D:
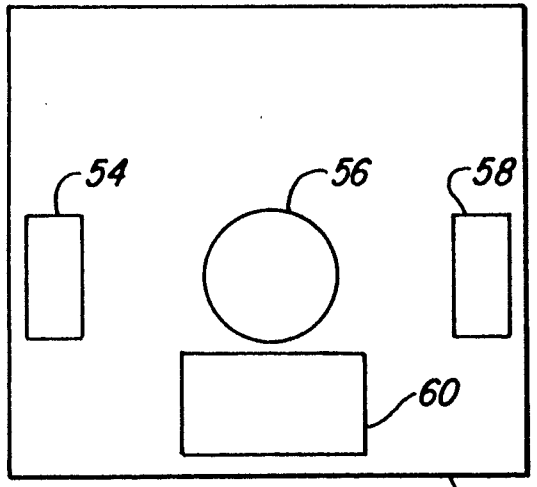
Figure 5:
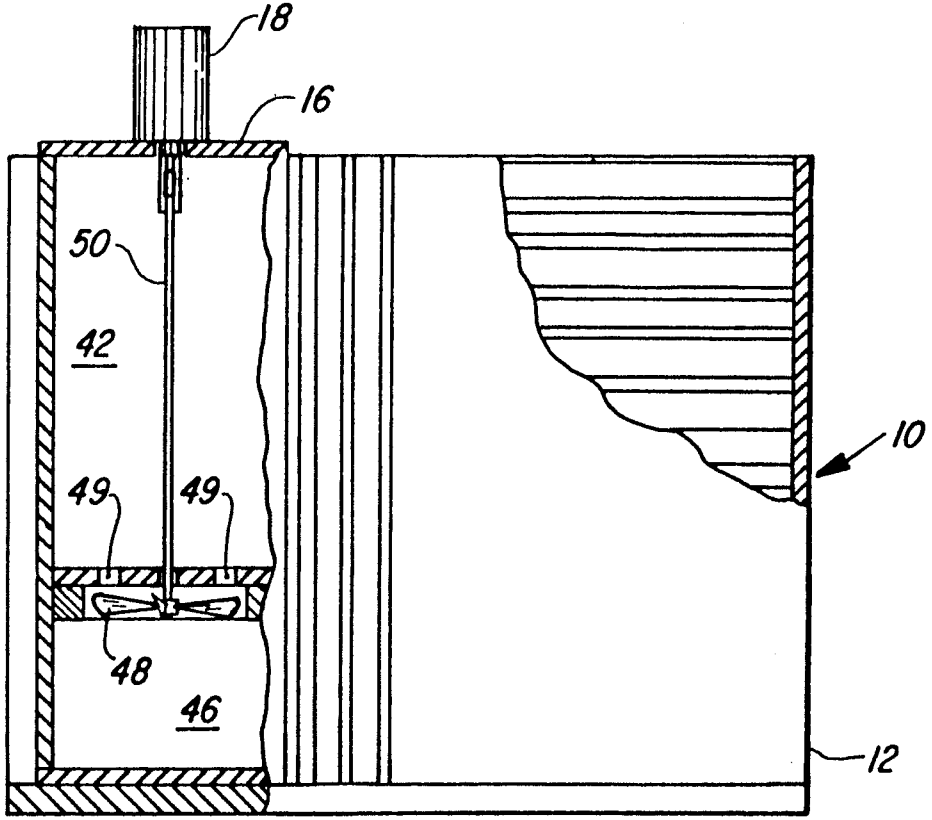
FIG. 5 is a front view of the processor shown in FIG. 1 partially cut away to show the pump chamber.

Referring to FIG. 1 of the drawings, there is shown a film processor 10 comprising a container or tank 12 defining a chamber 13 for processing solution or wash water and a housing or tank 16 for a pump 18. Interposed between the tanks 14 and 16 are a plurality of stacked walls or plates 22, 24, 26, 28, 30 and 32 (FIG. 4) which define the solution distribution channels for the processor. The plate 22 may comprise one side wall of tank 12. The plates 24–32 are suitably attached to walls 22 of the container tank 12, as shown in FIGS. 1 and 5. The tank 16 may be attached to end plate 32, as shown.

A plurality of elongated hydrostatic bearings 38 are positioned in chamber 14 in parallel spaced relationship with the configuration shown in FIG. 4G which is a view of the end wall 22 with the bearings mounted on it, to produce a curved film path as described below. The ends of the bearings 38 are fixed to the plate 22. As described in more detail below, the bearings 38 are immersed in processing solution in tank 12 and have internal cavities which are supplied with processing solution by pump 18 through the manifold defined by plates 22, 24, 26, 28, 30 and 32.

Figure 6:
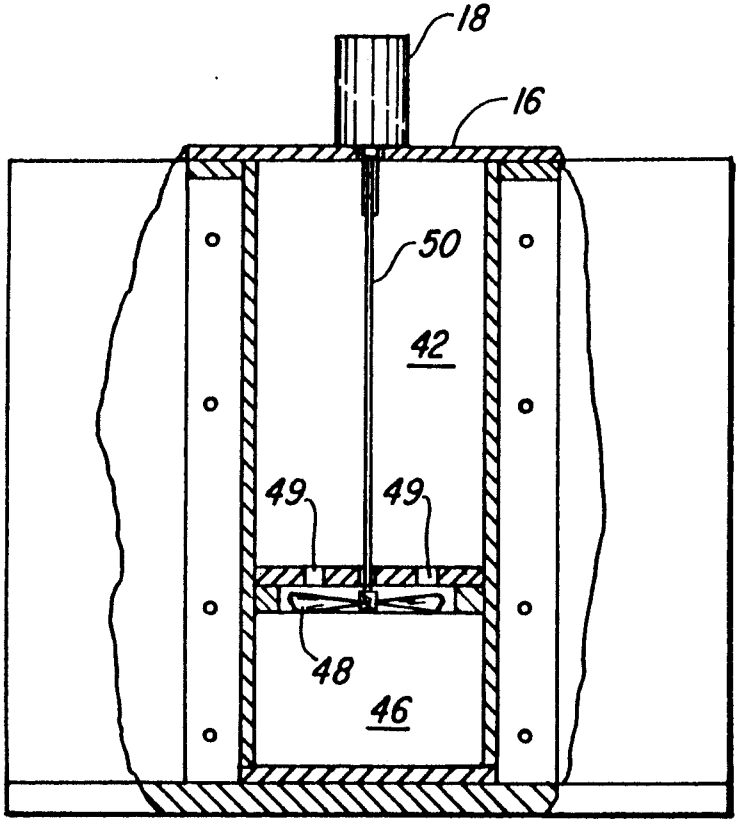
FIG. 6 is a side view of the processor shown in FIG. 1 partially cut away to show the pump chamber.

Plate or wall 32 (FIG. 4F) comprises a pump face or pump inlet and outlet plate and has an inlet opening 40 communicating with an inlet or suction chamber 42 (FIGS. 5 and 6) of the tank 16, and an outlet opening 44 for discharging solution from the high pressure or outlet chamber 46 of the tank 16. The pump impeller 48 is positioned in the outlet chamber 46 and is rotatable by pump shaft 50 to circulate solution form chamber 42 into chamber 46 through openings 49.

Plate 30 (FIG. 4E) comprises a solution return plate has an elongated rectangular opening 50 for circulating solution returned from the chamber 13 to the pump chamber 42 and has an opening 52 located to align with opening 44 of plate 32.

Plate 28 (FIG. 4D) serves to provide positive to negative pressure insulation and is provided with openings 54, 56 and 58 located to communicate with opening 50 in plate 30. The plate 28 is also provided with an opening 60 located to align with opening 52 of plate 30.

Plate 26 (FIG. 4C) is provided with a horseshoe-shaped opening 62 which communicates with the opening 60 in plate 28 and is provided with openings 63, 64 and 66, which are aligned with openings 54, 56 and 58, respectively, of plate 28.

Plate 24 (FIG. 4B) comprises an allocation manifold having solution return openings 68, 70 and 72 aligned with openings 63, 64 and 66 of plate 26. The plate 24 also has a plurality of equally-sized openings 74 (two for each bearing) arranged in a horseshoe pattern in alignment with the openings in the ends of the bearings 38 to distribute solution to the ends of the bearings from the opening 62 in plate 26.

Wall 22 (FIG. 4A) is almost identical to plate 24 and is provided with openings 76, 78 and 80 aligned with openings 68, 70 and 72, respectively, of plate 24. The plate 22 is also provided with a plurality of openings 82 (two for each bearing) aligned with but slightly smaller in size than openings 74 of plate 24 to gradually reduce the cross-section of fluid flow into the bearings 38. The bearings 38 are attached to the plate or wall 22 such as by welding of the bearing ends to the surfaces of wall 22 around the openings 82 whereby the openings 82 communicate with only the interiors of the bearings.

In operation of the fluid distribution system pump 18 will pump fluid from chamber 46 through openings 44, 52 and 60 of plates 32, 30 and 28, respectively, into the manifold opening 62 of plate 26. From opening 62 of plate 26, solution will be distributed through openings 74 and 82 of plates 24 and wall 22, respectively, to the interior of the hydrostatic bearings 38.

Fluid will be discharged from the bearings 38, as described in detail below, into tank 12. The discharged solution will be recirculated from tank 12 via openings 76, 78 and 80 in wall 22, openings 68, 70 and 72 in plate 24, openings 63, 64, and 66 in plate 26, openings 54, 56 and 58 in plate 28, opening 50 in plate 30 and opening 40 in wall 32 to the pump suction chamber 42.

Referring now to the unique features of the hydrostatic bearings 38, and specifically to FIGS. 1, 7, 8 and 9 of the drawings, each bearing comprises a pair of identical elongated juxtaposed assemblies 90*a* and 90*b* (FIGS. 8 and 9) positioned in spaced relationship to permit passage of a web W of light sensitive material in continuous or sheet form therebetween. Each assembly defines an elongated channel shaped housing 91 having a rectangular cross-section which receives solution under pressure from an opening 82 in plate 22. The housings 91*a* and 91*b* are fixed to flanges 92*a* and 92*b*, respectively which are each provided with a plurality of spaced openings 94*a* and 94*b*, respectively, for discharging fluid from the interior of the channels to the area external of said flanges. A second pair of flanges 96*a* and 96*b* are fixed to flanges 92*a* and 92*b*, respectively, and are each provided with a plurality of spaced rectangular openings 98*a* and 98*b*, respectively, which receive solution from openings 94*a* and 94*b*, respectively, to establish regions of pressurized solution on both sides of the sheet S.

Each pair of juxtaposed assemblies are positioned in closely spaced relationship with a small gap between the faces of flanges 96*a* and 96*b* for the passage of web W therebetween, as shown most clearly in FIG. 9. For a web having a thickness of 0.007 inches, the spacing is preferably 0.050 inches. This spacing is achieved by positioning spacers 99 (FIG. 9) between the two assemblies at both ends thereof. The assembled bearings are then attached at one end to the plate 22 with the open ends of channels 90*a* and 90*b* aligned with a pair of openings 82. The other ends of the channels 90*a* and 90*b* are fixed together and sealed by an end cap 101 (FIG. 1) to restrict discharge of solution to openings 94. The fixed mounting of one end of the bearing 38 to the plate 20 and the attachment of the end cap 101 provides a rigid bearing structure.

The bearings are preferably sized to define fluid path lengths within the bearing such as to evacuate solution into the tank when the fluid boundary layer reaches a predetermined thickness. Such criteria is specifically disclosed in the application Ser. No. 07/633,505, now U.S. Pat. No. 5,136,323, incorporated herein by reference.

The plumbing system is preferably structured to produce a fluid pressure of 2–6 inches of water in each of the rectangular openings 98*a* and 98*b*. With this arrangement, a liquid cushion will exist on each side of the web within each bearing to provide for smooth transport of the web without contact with the bearing surfaces.

In the relatively straight portions of the web path, the juxtaposed face surfaces of the flanges 96*a* and 96*b* are flat, as shown in FIG. 9 and in detail in FIG. 10A. However, in the curved portions of the web path, the juxtaposed face surfaces of the flanges 96*a* and 96*b* are curved to define a curved web path therebetween. In these path sections, one flange 96 will be provided with a concave surface 100, as shown in FIG. 10C and the opposing flange 96 will be provided with a complemental convex surface 102, as shown in FIG. 10B. The curved web path thus established will be apparent from viewing the lower four bearings in FIG. 7.

Figure 7:
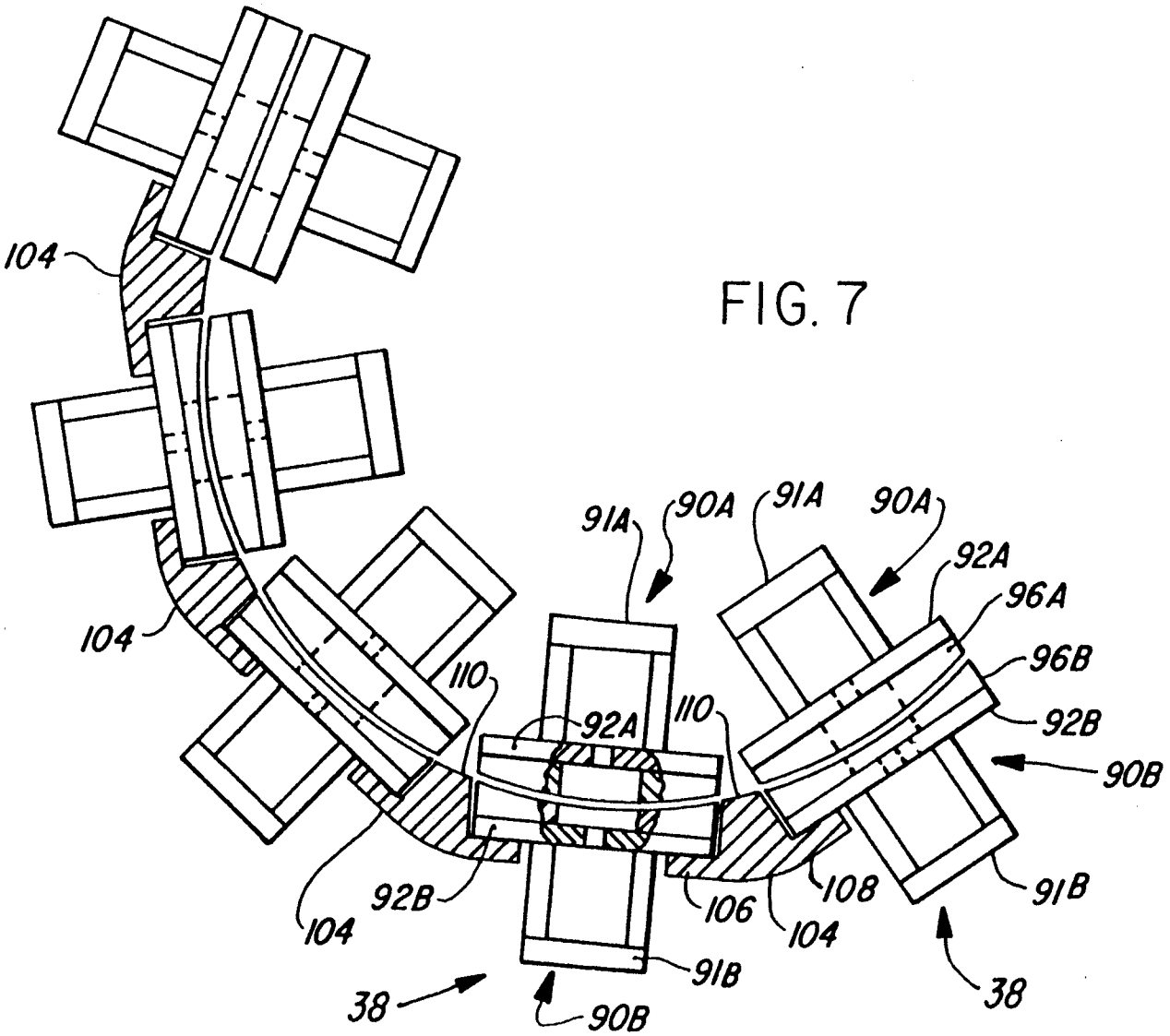
FIG. 7 is an enlarged view of the bottom group of hydrostatic bearings.
Figure 8:
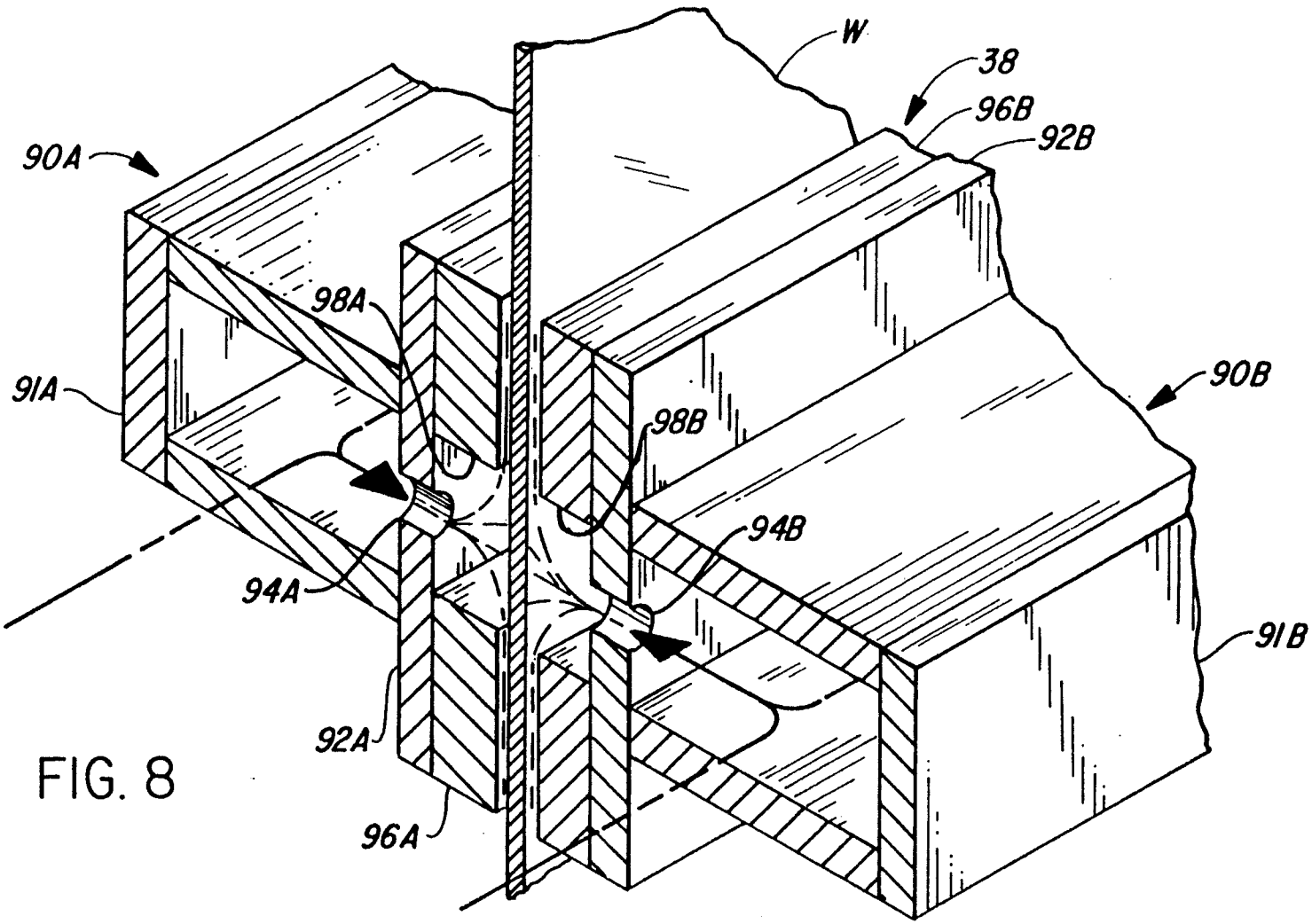

A bridging means is provided between adjacent bearings 38 to insure that the leading edge of the web leaving one bearing feeds correctly into the next bearing in the web path. Referring to FIG. 7 of the drawing, an arcuate bridging member 104 is positioned between adjacent bearings. Flanges 106 and 108 of the member 104 are fixed to the flanges 92 of the adjacent bearings 38 to position the surface 110 of member 104 into contiguous relationship with the surfaces of the flanges 96*b*. The surface 110 thus defines a bridge between the gaps of adjacent bearings.

In FIG. 7, the bearings 38 are depicted in a curved film path. It will be apparent, however, that various path configurations may be employed and the disclosed configuration is exemplary only.

Figure 3:
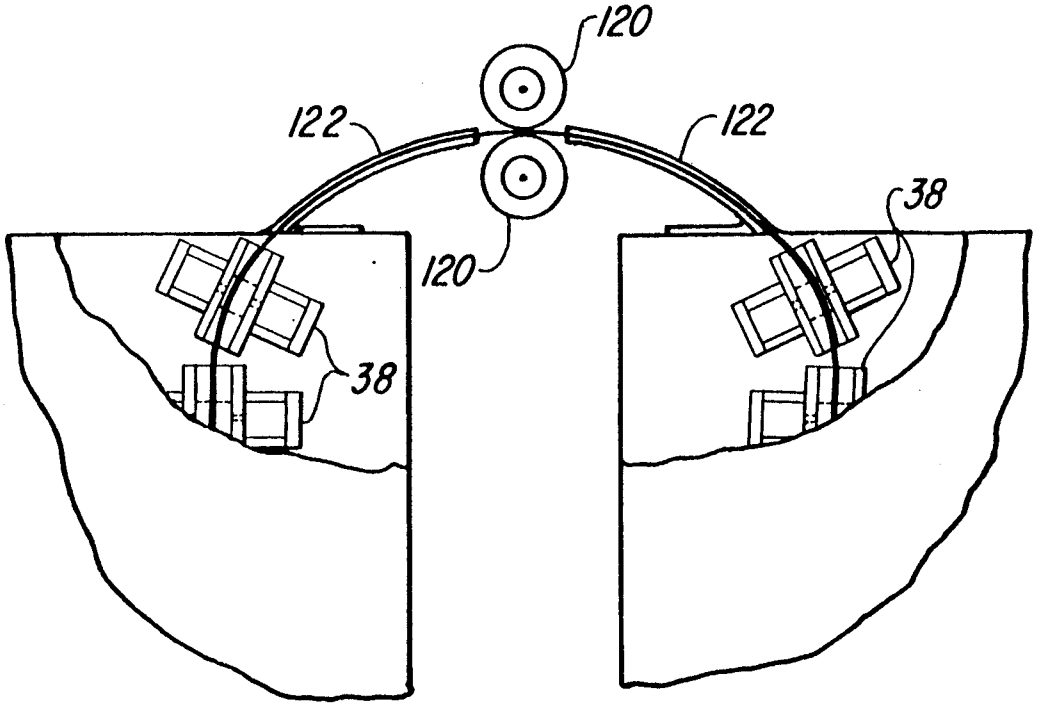
FIG. 3 is an elevation view illustrating the transport of film between two processor tanks.

If the web being processed is in sheet form such as, for example, X ray sheet film, the film path defined by the hydrostatic bearings 38 will be shorter than the length of the film sheets so that roller means at the entrance and exit to the path can transport the sheets into and out of the path without losing the sheet. In such a sheet film processor, a pair of rollers 120, as shown in FIG. 1, will be positioned at the entrance and exit of the tank chamber. If a series of processing chambers are provided, a pair of rollers 120 may be provided between adjacent tanks, as shown in FIG. 3. In this case, film guides 122 would be provided to facilitate transport between adjacent chambers.

If the material being processed is a continuous web, such as spliced together lengths of 35 mm film, a roller means, such as rollers 120, may be provided only at the entrance to the web path, such rollers being sufficient to transport the film through the bearings supported by the liquid cushions. In this case, the rollers 120 between adjacent chambers are not necessary and the rollers 120 at the entrance to the first chamber can be used to transport the web through the entire system.

Figure 11:
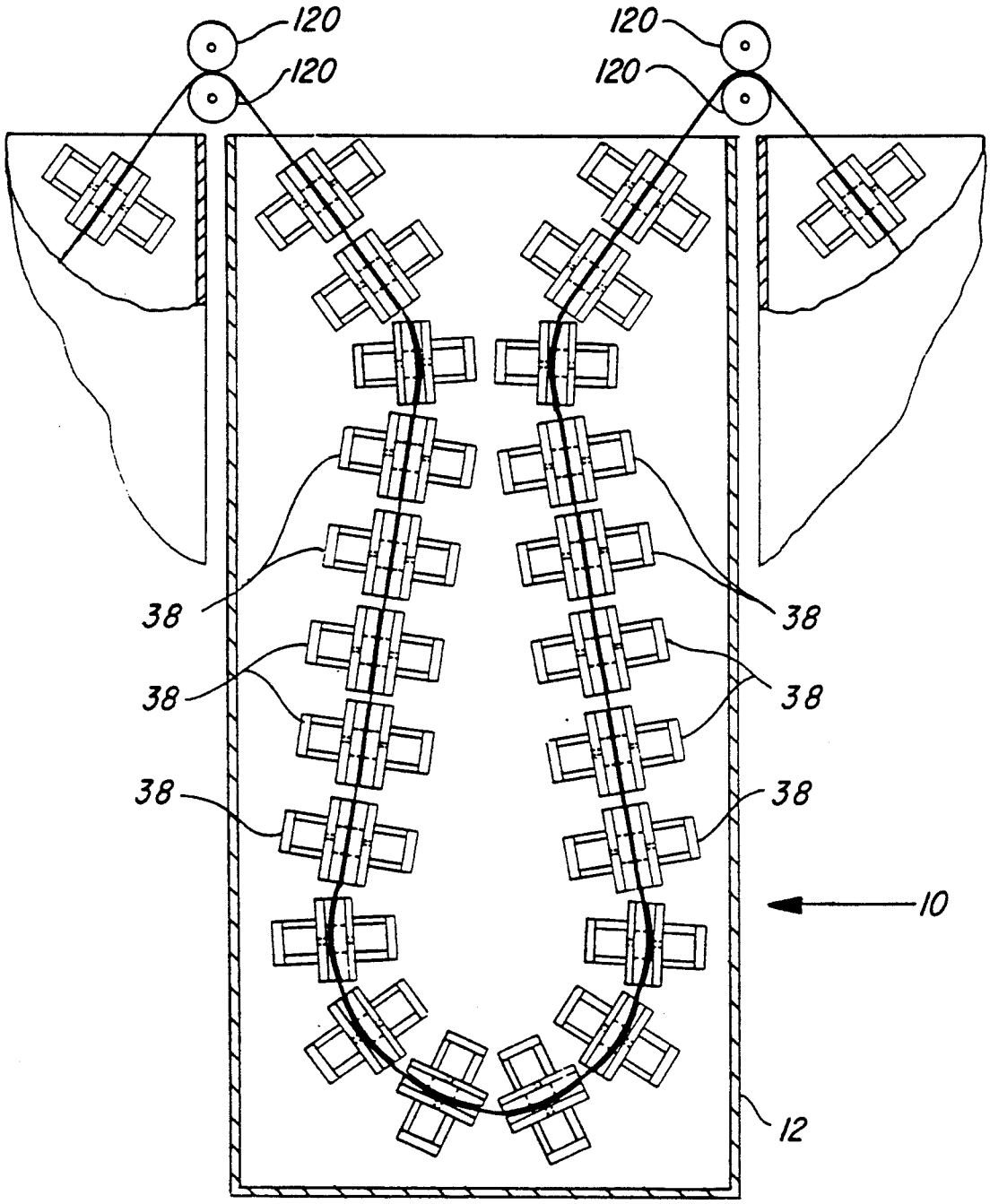
FIG. 11 is a side view of the hydrostatic bearings of another embodiment of the processor.

FIGS. 1 and 7 of the drawings show an arrangement of hydrostatic bearings for a single chamber processor. In this case, the bearings 38 would be arranged in a simple horse shoe configuration. However, if multiple chambers are provided, the bearings would preferably be arranged in the festooned configuration shown in FIG. 11 so that the web or sheet leaves each chamber along a smoothly curved film path.

In the case of both sheet and continuous webs, it may be desirable to have rollers between chambers of multiple chamber process to provide a squeegee effect for removing liquid from the material before it enters the next chamber.

The advantages of the disclosed processor will now be apparent. The fluid cushions established in the rectangular openings and adjacent regions effectively support the web being processing and permit it to be transported through the processing solution. Also, the system is constantly subjecting the web to recirculated fluid discharged from the bearings to reduce fluid stagnation. Thus, the bearings not only support the web, but render the treatment process more efficient.

With respect to each bearing, fluid is injected from the center region of the bearing and discharged at the sides. This arrangement provides discharging fluid streams on both sides of the web at both the entrance and exit of the bearing and avoids lifting of the web into engagement with the bearing surfaces.

It is to be understood that the terms "solution" or "liquid" as used herein are intended to encompass washing solutions and other liquids including pure water.

Those skilled in the art to which the invention relates will appreciate that other substitutions and modifications can be made to the described embodiment without departing from the spirit and scope of the invention as described by the claims below.

I claim:

1. In a processor for light sensitive web material having a chamber for liquid and having a web path, the improvement comprising:

a plurality of hydrostatic bearings positioned within the chamber, each of said bearings comprising a pair of spaced juxtaposed housings having respective juxtaposed apertures, said housings being positioned to receive the web therebetween, each said housing having a side facing the web;

means for supplying liquid under pressure to each of said housings of each of said bearings to discharge liquid through said apertures on opposite sides of the web to establish within each of said bearings cushions of pressurized liquid on opposite sides of the web and a flow of liquid from said apertures along the web and from each bearing into the chamber; and means for supporting said bearings within the chamber in spaced relationship whereby each of said bearings functions independently of the other of said bearings.

2. In a processor as claimed in claim 1 wherein each of said bearings comprise flanges attached to the sides of said housings facing the web, said flanges having rectangular openings communicating with said apertures for establishing said cushions of pressurized liquid in said rectangular openings on opposite sides of the web.

3. In a processor as claimed in claim 2 wherein the liquid on opposite sides of the web flows form said rectangular openings along the web and into the processor chamber.

4. In a processor as claimed in claim 1 wherein said supporting means supports said bearings in a predetermined path for processing sheets of light sensitive material, the predetermined path having a length less than the length of a sheet.

5. In a processor as claimed in claim 4 further including roller means for transporting the sheets into the first of said bearings in said predetermined path.

6. In a processor as claimed in claim 5 further including pump means for circulating liquid from the chamber to said hydrostatic bearings.

7. In a processor as claimed in claim 6 wherein each of said hydrostatic bearings comprise a pair of housings on opposite sides of the sheet path and having interior space for receiving liquid from said pump means, said apertures being formed in said housings respectively.

8. In a processor as claimed in claim 7 wherein each of said bearings comprise flanges attached to the sides of said housings facing the web, said flanges having rectangular openings communicating with said apertures for establishing a cushion of pressurized liquid adjacent to the web.

9. In a processor as claimed in claim 6 wherein a plurality of such chambers are provided, each containing a plurality of said hydrostatic bearings for successively passing the sheets through different processing liquids.

10. In a processor as claimed in claim 9 further including roller means between adjacent chambers for transporting the sheets from one tank to the next.

11. In a processor as claimed in claim 1 further including bridging means between adjacent hydrostatic bearings in the path to guide the leading edge of a web leaving one bearing into the next bearing in the path.

* * * * *